US006188055B1

(12) United States Patent
Walters

(10) Patent No.: US 6,188,055 B1
(45) Date of Patent: Feb. 13, 2001

(54) MICROMESH HEATING MATERIAL AND FOOD PACKAGES MADE THEREFROM

(75) Inventor: Glenn J. Walters, Duxbury, MA (US)

(73) Assignee: Advanced Deposition Technologies, Inc., Taunton, MA (US)

( * ) Notice: Under 35 U.S.C. 154(b), the term of this patent shall be extended for 0 days.

(21) Appl. No.: 08/954,803

(22) Filed: Oct. 21, 1997

Related U.S. Application Data

(63) Continuation-in-part of application No. 08/758,697, filed on Dec. 3, 1996, now abandoned.

(51) Int. Cl.[7] ..... H05B 6/80

(52) U.S. Cl. ..... 219/730; 219/759; 426/107; 426/234; 426/243; 99/DIG. 14

(58) Field of Search ..... 219/730, 728, 219/759, 634; 426/107, 109, 241, 234, 243; 99/DIG. 14

(56) References Cited

U.S. PATENT DOCUMENTS

| | | | | |
|---|---|---|---|---|
| 3,302,632 | * | 2/1967 | Fichtner | 219/730 |
| 3,783,220 | | 1/1974 | Tanizaki | 219/730 |
| 4,267,420 | | 5/1981 | Brastad | 219/730 |
| 4,641,005 | | 2/1987 | Seiferth | 219/730 |
| 4,835,352 | * | 5/1989 | Sasaki et al. | 219/759 |
| 4,933,193 | * | 6/1990 | Fisher | 426/107 |
| 4,982,064 | * | 1/1991 | Hartman et al. | 219/730 |
| 5,038,009 | * | 8/1991 | Babbitt | 219/730 |
| 5,075,526 | * | 12/1991 | Sklenak et al. | 219/730 |
| 5,412,187 | | 5/1995 | Walters et al. | 219/728 |
| 5,500,511 | * | 3/1996 | Hansen et al. | 219/634 |
| 5,633,073 | * | 5/1997 | Cheung et al. | 428/209 |
| 5,916,469 | * | 6/1999 | Scoles et al. | 219/633 |

FOREIGN PATENT DOCUMENTS

| | | | | |
|---|---|---|---|---|
| 2160924 | | 6/1973 | (DE) . | |
| 0 344 839 | * | 12/1989 | (EP) | 219/730 |
| 0 365 729 A2 | | 2/1990 | (EP) . | |
| 64-58620 | * | 3/1989 | (JP) . | |

* cited by examiner

*Primary Examiner*—Philip H. Leung
(74) *Attorney, Agent, or Firm*—Wolf, Greenfield & Sacks, P.C.

(57) ABSTRACT

A microwave heating material is formed of a micromesh conductive coating on a substrate. The micromesh includes a plurality of closely spaced, fine lines of a conductive material such as aluminum. The conductive material may have a resistivity of about 1–50 Ω/□. The microwave heating material may include electrically and physically discontinuous islands of micromesh, each of which may optionally be connected to another only by a susceptor fuse region. The microwave heating material is laminated to a supporting material which may be incorporated into wraps, bags, boxes, trays, and other food containers.

25 Claims, 5 Drawing Sheets

MICROMESH HEATING MATERIAL AND FOOD PACKAGES MADE THEREFROM

This application is a continuation-in-part of application Ser. No. 08/758,697, filed Dec. 3, 1996 now abandoned.

BACKGROUND

1. Field of the Invention

The present invention relates generally to the field of electromagnetically excited heating materials and articles made therefrom, particularly those used in food packaging for improving the cooking, heating or browning of food in microwave ovens.

2. Related Art

Microwave heating materials have been in use and described in publications for over twenty years. An example of a microwave heating material is a microwave susceptor constructed of a coating on a film or substrate in which the coating absorbs microwave energy, converts it into heat and conducts the heat generated into food articles placed in close proximity thereto. Microwave susceptors are particularly useful in microwave food packaging to aid in browning or crisping those foods.

The field of microwave susceptor packaging technology includes numerous attempts to optimize heating, browning and crisping of food cooked in microwave ovens. Such attempts include German Patent Number 2,160,924 issued 1971, which first described a food wrap using a carbon or metal coated material to achieve browning and crisping in a microwave oven. Later, U.S. Pat. No. 3,783,220 describes a plate or fixture which uses either carbon fibers or semiconducting coatings such as tin oxide to produce browning and crisping temperatures in a microwave oven. Yet more recently, U.S. Pat. No. 4,267,420, issued May 1981, and U.S. Pat. No. 4,641,005, issued February 1987, describe substantially similar structures of either semiconductor coatings or thin metallic coatings on thin film substrates such as polyester.

One feature common to all of the above-mentioned conventional technology is the randomness of the electric fields which are generated by a microwave oven in the vicinity of these structures. Ultimately, corresponding, randomly directed eddy currents flowing in a resistive coating such as aluminum generate heat.

Heating in a susceptor material is achieved through so-called "$I^2R$" losses in the material. Power dissipation P in a resistive material having a resistance R is a function of current I, where $P \approx I^2R$. The power dissipation P in microwave susceptor material occurs in the form of heat. The current I is the eddy current generated by microwave energy impinging on the susceptor material, while the resistance R is the resistance of the susceptor material through which the current I flows.

A more recent article disclosed by the present inventor in U.S. Pat. No. 5,412,187, issued May 1995 employs a pattern of metal which is physically discontinuous, forming fuses. The fuse patterns create a self-limiting heat source, such that when too much energy is absorbed by a particular region, the fuse breaks between adjacent susceptor areas and the heating effect is mitigated.

However, all of the most recent susceptors discussed above, have a tendency to develop random cracks and crazing of the conductive coating. This problem is thought to be due to distortion of the substrate film resulting from excess heating. Furthermore, in conventional susceptors the eddy currents are free to flow in a completely random and non-oriented fashion, as noted earlier.

The only conventional susceptors found by this inventor to be commercially viable for use in microwave oven heating applications are those which are made with thin layers of aluminum typically exhibiting a range of 75–125 Ω/□ or about 0.25 optical density. Heavier thicknesses of aluminum, for instance, have been found not to provide the browning and crisping temperatures desired while frequently causing fires due to severe arcing. Thinner layers of aluminum generally do not present a fire hazard, but produce an insufficient temperature rise for the intended purpose.

However, customers for microwave food heating products routinely request faster heat production and production of higher temperature rises. No conventional solutions have proven commercially viable or technically feasible.

SUMMARY OF THE INVENTION

The present invention solves the problems noted above, providing higher temperatures at a faster rate, safely. The present invention also provides a structure which is more easily tuned at time of manufacture for specific customer temperature requirements. Other advantages of the present invention will be recognized by those skilled in this art upon reading this disclosure.

My invention is a thin high resolution micromesh of microwave absorbing, electrically conductive coating deposited on a substrate suitable for use in a microwave oven to produce browning and crisping, as well as improved heating characteristics. Such a micromesh may, for example, be formed of 1–50 Ω/□ vapor deposited aluminum and have a line resolution of between about 20 and 200 lines per inch. Preferred line resolutions tend to lie between about 75 and 100 lines per inch. Temperature rises produced by this structure have exceeded a standard susceptor device by 25% or more. Furthermore, the heat generated per unit time is also greater. Surprisingly, the measured reflection/transmission/absorption (RTA) of the invented material has been readily tuned to be around 25% reflection, 25% transmission and 50% absorption. As described in Charles R. Buffler, *Microwave Cooking and Processing*, Van Nostrand & Reinhold, 1993, these are the values of a hypothetical ideal susceptor material. Not only does this material outperform conventional susceptor materials, but it can be cost effectively produced.

BRIEF DESCRIPTION OF THE DRAWINGS

Embodiments of the present invention will now be discussed in connection with the Figures. Like reference numerals indicate like elements in the figures, in which.

DETAILED DESCRIPTION

The present invention will be better understood in view of the following detailed description of various embodiments thereof, read in connection with the figures.

Figure 1A:
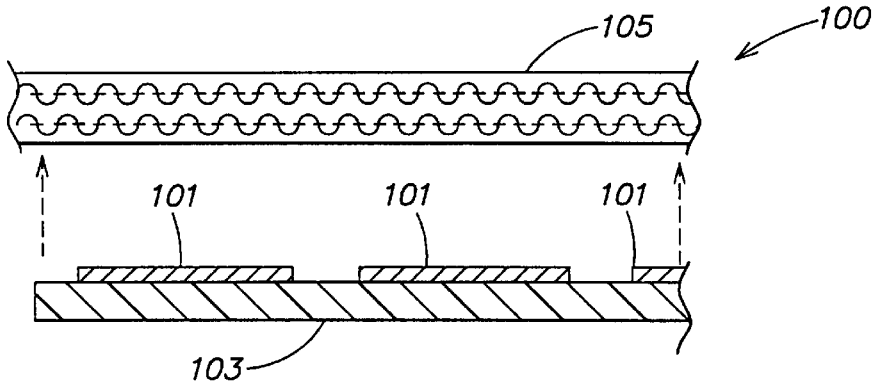
FIG. 1A is a cross sectional view of a susceptor heating material made in accordance with one aspect of the present invention, the cross-section taken along line 1A—1A of FIG. 1B.
Figure 1B:
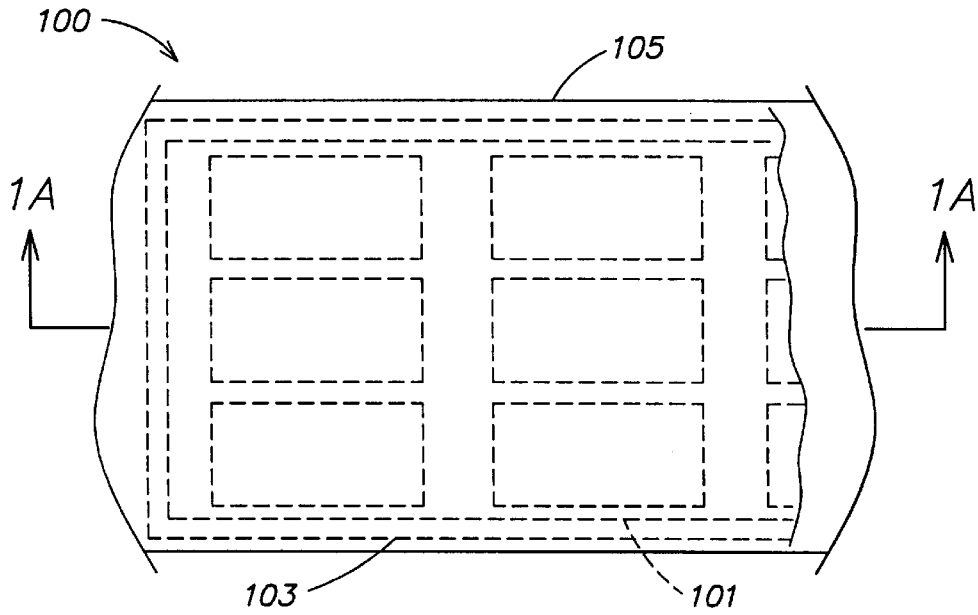
FIG. 1B is a plan view of a susceptor material made in accordance with the aspect shown in cross-section if FIG. 1A of the present invention.

The invention is now generally described in connection with FIGS. 1A and 1B. The micromesh 101 of one embodiment of the present invention is formed of a metal vapor deposited onto a substrate film 103 and then laminated either to a thicker plastic, paper, paperboard, or cellulose supporting material 105. The laminate can then be used to wrap foods or can be formed by conventional techniques into the shape of a food container.

The micromesh 101 may be produced by a variety of techniques known in the art. For example, the micromesh maybe formed of a metallic layer which has been vapor deposited or plated onto the substrate 103. After vapor deposition or plating a full coverage metal layer, the metal layer maybe etched to form micromesh 101. An alternate and preferred method of forming the micromesh 101 is the pattern metallization method disclosed in detail in Walters et al., U.S. Pat. No. 5,412,187, issued May 2, 1995 and incorporated herein by reference. By the pattern metallized printing method disclosed therein, the micromesh 101 is directly formed by vapor deposition on the substrate 103.

An embodiment of the invention has been described in which the micromesh 101 is formed of a metal. However, other conductive materials may be used. For example, semiconducting materials and tin oxide are suitable. When a metal is used to form micromesh 01, a 1–50 Ω/□ layer of aluminum is preferred. Metals are preferred over non-metals for use in connection with the present invention because of their low cost and compatibility with the preferred method of making the material. Suitable metals include, in addition to aluminum, iron, tin, tungsten, nickel, stainless steel, titanium, magnesium, copper and chromium or alloys thereof. Oxides or partial oxides of some of these metals may also be suitable conductive materials.

The substrate 103 carrying the micromesh structure 101 is then laminated to a paper, paperboard, cellulose or other suitable supporting material 105. Usually, the laminate will be formed with the micromesh structure 101 disposed between the substrate 103 and the supporting material 105. This affords the micromesh structure 101 protection against abrasion or direct food contact.

Figure 2:
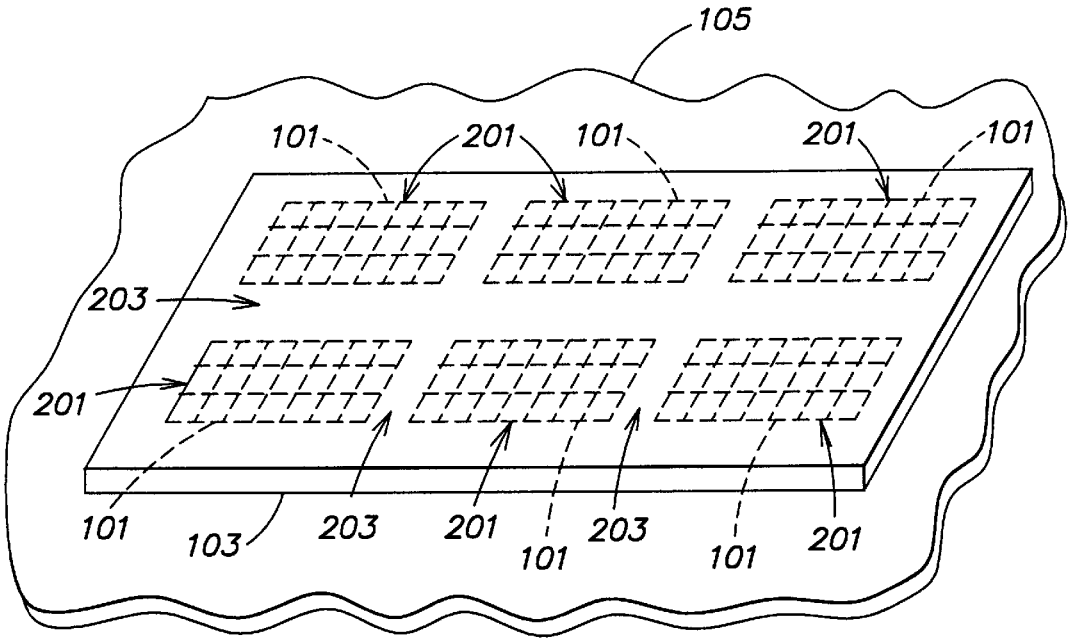
FIG. 2 is a partial perspective view of another embodiment of a susceptor material made in accordance with another aspect of the present invention.

In another embodiment of the invention, shown in FIG. 2, the susceptor area of a food package is covered by electrically and physically isolated islands 201 of metallic micromesh structure 101. Channels 203 of area not having metal deposited thereon separate each island 201 from another.

Typical applications of the micromesh structure described above include food wraps, bags, boxes and trays as shown in FIGS. 3–6.

Figure 3:
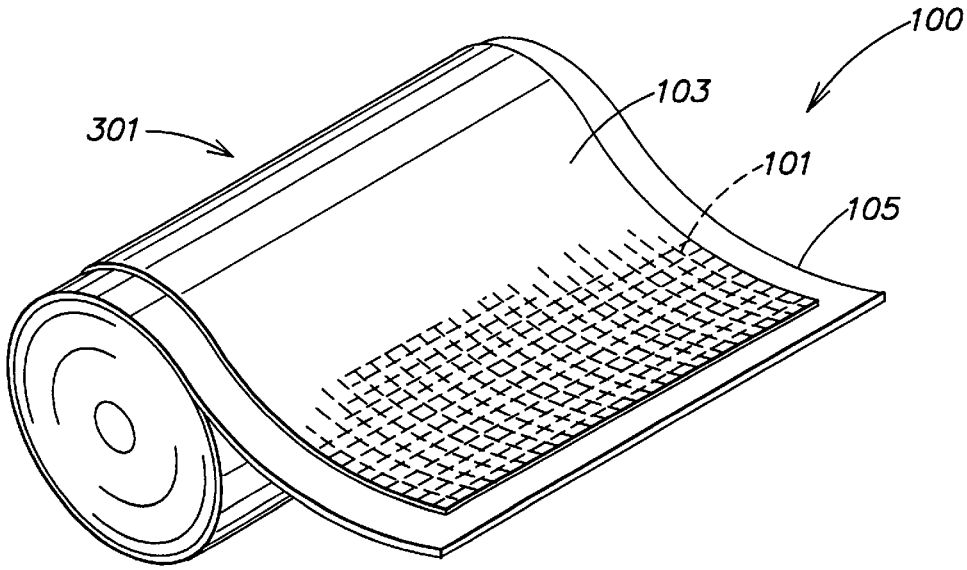
FIG. 3 is a perspective view of a row of food wrap made in accordance with an aspect of the present invention.

FIG. 3 shows a roll of food wrap material 301, formed in accordance with the present invention. In this embodiment, the entire food wrap material 301 is composed of or covered by susceptor material 100 including a substrate 103 carrying a conductive micromesh structure 101 as described above in connection with FIGS. 1A and 1B. The wrap may include a supporting material 105 of, for example, paper. Such a material may be wrapped around an arbitrarily shaped food item and placed in a microwave oven for overall surface browning or crisping. The complete structure, including the substrate 103, the supporting material 105 and the micromesh structure 103, will generally have the micromesh structure disposed between the substrate 101 and the supporting material 105 for protection as described above.

Figure 4:
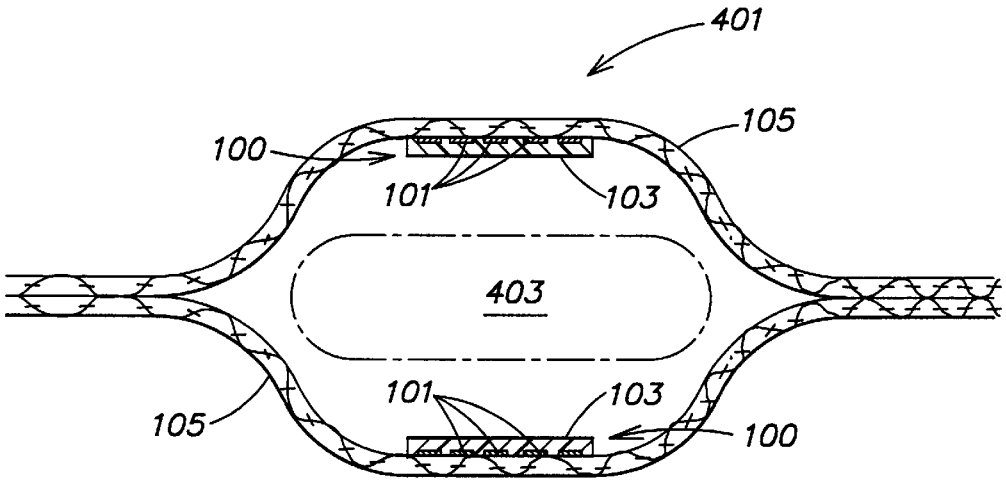
FIG. 4 is a cross-sectional view of a microwave food bag made in accordance with an aspect of the present invention.
Figure 5:
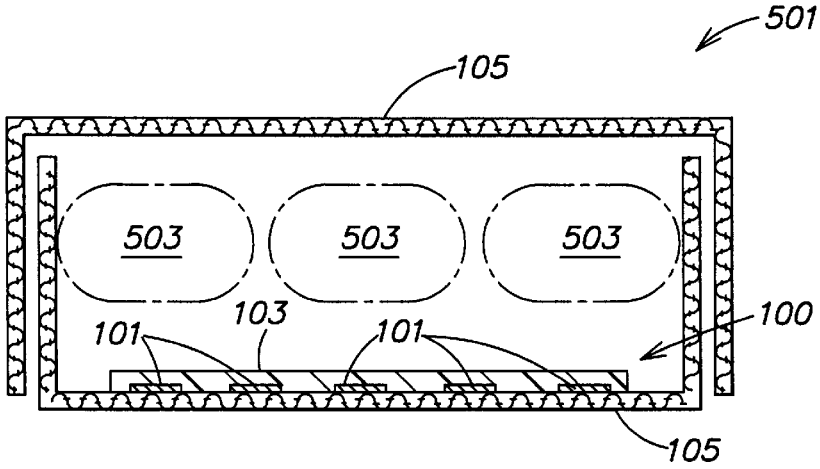
FIG. 5 is a cross-sectional view of a microwave food box made in accordance with an aspect of the present invention.

Prepackaged food items may be provided in bags, such as shown in FIG. 4 or boxes, such as shown in FIG. 5. The bag 401 of FIG. 4 shows another use of micromesh susceptor material, such as shown in FIGS. 1A, 1B and 2. Supporting material 105 may be flexible paper or plastic material suitable for use in food bags. Substrates 103 having the micromesh structure 101 formed thereon are laminated to selected portions of supporting material 105. The complete structure, including the substrate 101, the supporting material 105 and the micromesh structure 103, will generally have the micromesh structure disposed between the substrate 101 and the supporting material 105 for protection as described above. A food article may occupy the interior space 403 between susceptor areas 100. In the box 501 of the FIG. 5, a susceptor area 100 may be provided in a base portion of a box. The box may be formed of a suitable supporting material 105 for susceptor substrate 103 and micromesh structure 101, such as paperboard.

Figure 6:
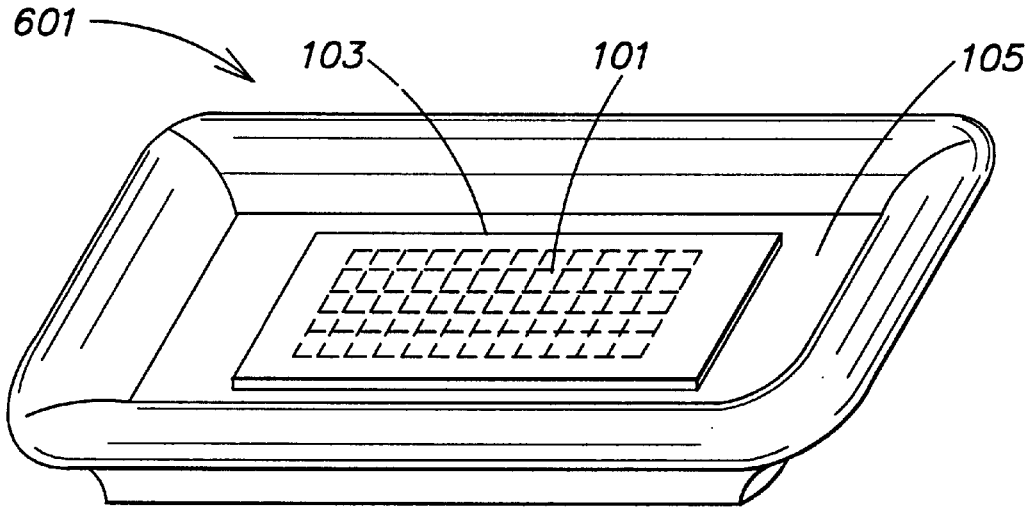
FIG. 6 is a perspective view of a microwave food tray made in accordance with an aspect of the present invention.

Finally as shown in FIG. 6 a paperboard supporting structure 105 carrying susceptor substrate 103 having disposed thereon micromesh structure 101 may be formed into a microwaveable food browning tray. Alternatively, supporting material 105 may be plastic or another microwave and food compatible material. As in the above-described structures, the complete structure, including the substrate 103, the supporting material 105 and the micromesh structure 101, will generally have the micromesh structure disposed between the substrate 101 and the supporting material 105 for protection as described above.

It is preferred for all the forgoing and other food contact applications that substrate 103 is formed of a 12 $\mu$m thick film of polyester. However, other substrates may be used which exhibit microwave transparency, heat tolerance and compatibility with food products. Materials which have been found suitable for use in the substrate include polyethyleneteraphathalate (PET), polyethylenenaphthalate (PEN), polycarbonate, nylon, polypropylene and other plastics approved for direct food contact. The substrate 103 will protect the micromesh structure 101 from direct food contact. The substrate 103 and micromesh structure 101 is laminated to a paper, paperboard or cellulose supporting material 105 with the micromesh structure protected by the substrate on one surface and the supporting material 105 on the other.

In micromesh structures according to various aspects of the invention, of course, the islands 201 need not be rectilinearly arranged, but may instead form any desired pattern of separate islands. The current flow within each island 201 or region of micromesh structure 101 is now forced to flow along very narrow lines of metal which measure as little as 0.005" in width and can have resistivities of as much as 1–50 Ω/□. In contrast, the current flow in conventional susceptor devices is random. While the invention is not limited to a particular theory of operation, it is believed that by forcing the current to flow along such narrow conductive paths, higher current densities are induced than are induced in conventional materials. Thus, the heat flux is higher and the maximum temperature rise is also higher. In fact, the temperature rise can be made to exceed requirements by using a micromesh structure covering all available susceptor area. The embodiment of FIG. 2, using islands 201 and channels 203 can mitigate any excess heat production. For instance, a typical prior art susceptor heater material measures 25–40 sq. in. dependent upon the food item. The heating area of the FIG. 2 embodiment may include islands 201 as small as 0.05 sq. in. or as large as 4 sq. in. Each micromesh island 201 is completely separate from adjacent micromesh islands 201 to avoid unnecessarily high temperatures. Thus, viewed over the overall available susceptor area, these micromesh structures 101 are typically both physically and electrically discontinuous.

Susceptors constructed in accordance with aspects of this invention can be tuned by varying any one or more than one of the following parameters:

Width of lines (0.05"–0.005" typ).

Distance between lines (0.05"–0.005" typ).

Thickness of lines (metal deposition thickness) (0.05"–0.002" typ.)

Size of micromesh islands (0.05" sq. in.–4 sq. in. typ).

It should be noted that many permutations can produce desirable heating temperatures and uniformity of heating. Values outside the stated ranges are also useable; the stated ranges merely define typical parameter values.

As will be understood by the skilled artisan, some parameter choices will not be effective and may even self-destruct in a microwave environment. For instance, a micromesh screen of 1–50 Ω/□ aluminum which otherwise approximates the geometry of the metal grid structure found in the windows of microwave oven doors will generate severe arcing and possible fires. However, by comparison, typical microwave door window screens are made of very thick metal (>0.001") having relatively low sheet resistivity and thus can conduct high current without heating up appreciably.

An unexpected benefit of susceptor construction in accordance with the invention is that these micromesh susceptors survive longer duration exposure to high-level microwave fields, contrary to conventional wisdom. Conventional wisdom held that any device in which sufficient heat for cooking food is generated will exhibit severe physical deformation leading to self-destruction. Not only do the inventive structures survive better, but they have shown a unique capability to generate high temperatures with reduced fracturing or crazing. The inventive structures exhibit less physical distortion after prolonged use than conventional susceptors or fused susceptors, e.g. as shown in U.S. Pat. No. 4,641,005 and U.S. Pat. No. 5,412,187, and far less deterioration of the conductive elements than comparable areas of conventional susceptor material.

Figure 7:
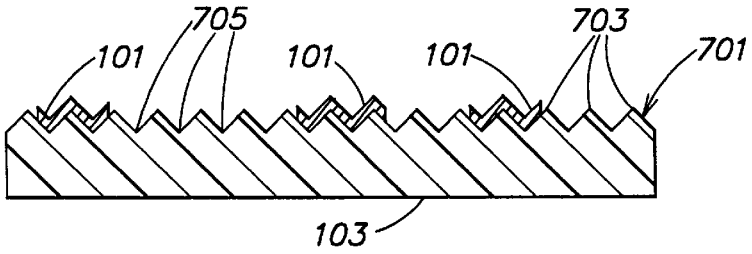
FIG. 7 is a cross-sectional view of a susceptor material made in accordance with another aspect of the invention.
Figure 8:
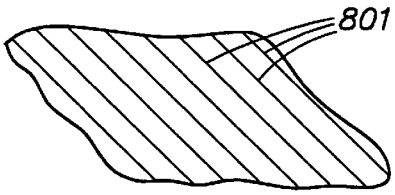
FIGS. 8, 9 and 10 are plan views of patterns in which the embodiment of FIG. 7 may be formed.
Figure 9:
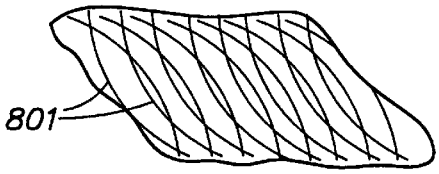
Figure 10:
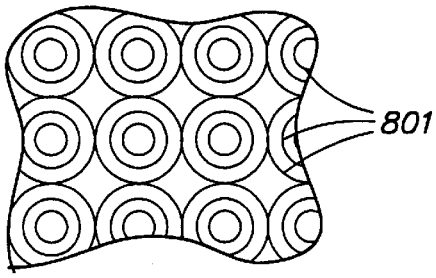

Performance of the susceptor construction described above can be further enhanced by forming the micromesh screen 101 on a substrate 103 whose surface 701 includes a surface relief pattern of very fine lines (FIGS. 8, 9 and 10; 801) defined by a sequence of peaks 703 and valleys 705, as shown in FIG. 7. The pattern of lines, as illustrated in plan view in FIGS. 8, 9 and 10, may include parallel, straight or curved lines (FIG. 8), straight or curved lines which cross (FIG. 9), concentric circles (FIG. 10), combinations of the above, etc. The spacing between adjacent peaks defining non-intersecting lines may range from about 0.1 microns to about 250 microns. A suitable spacing between such peaks is about 0.1 microns. For example, the pattern may resemble an optical diffraction grating or hologram, and may be produced by the same conventional embossing or casting techniques used for producing commercial holograms or diffraction gratings.

The present invention has now been described in connection with a number of specific embodiments thereof. However, numerous modifications which are contemplated as falling within the scope of the present invention should now be apparent to those skilled in the art. For example, micromesh may take the geometric form of plural, parallel fine lines, or the micromesh may take the geometric form of a grid of intersecting fine lines. Therefore, it is intended that the scope of the present invention be limited only by the scope of the claims appended hereto.

What is claimed is:

1. A substrate heating material, comprising:

a dielectric film substrate; and a lossy conductive high resolution micromesh of lines between 0.05" and 0.005" wide, separated by between 0.05" and 0.005" and supported by the dielectric film substrate.

2. The material of claim 1, wherein the high resolution micromesh further comprises vapor deposited aluminum.

3. The material of claim 2, wherein the high resolution micromesh has an RTA of about 25%/25%/50%.

4. The material of claim 1, wherein the conductive members have a resistivity of 1–50 Ω/□.

5. The material of claim 1, wherein the high resolution micromesh is supported by a surface relief pattern on the substrate comprising a fine line pattern defined by a sequence of peaks and valleys.

6. The material of claim 5, wherein a distance between peaks defining non-intersecting lines is between about 0.1 microns and about 250 microns.

7. The material of claim 6, wherein the distance is about 0.1 microns.

8. The material of claim 5, wherein the fine line pattern is embossed into the substrate.

9. The material of claim 5, wherein the fine line pattern is cast into the surface of the substrate.

10. A food package comprising:

a dielectric film substrate;

a susceptor region including a lossy conductor defining a high resolution micromesh pattern of lines between 0.05" and 0.005" wide, separated by between 0.05" and 0.005" and supported by the dielectric film substrate; and a food container to which the lossy conductor and substrate are laminated, the lossy conductor being disposed between a wall of the food container and the substrate.

11. The food package of claim 10, wherein the susceptor region includes a plurality of separate lossy conductors each having a micromesh pattern, and each electrically and physically discontinuous from another.

12. The food package of claim 10, wherein the susceptor region includes a plurality of separate lossy conductors each having a micromesh pattern, and each connected to another only by a susceptor fuse region.

13. The food package of claim 10, wherein the food container is an unformed flexible wrap.

14. The food package of claim 13, where the wrap is plastic.

15. The food package of claim 13, wherein the wrap is cellulose.

16. The food package of claim 13, wherein the wrap is paper.

17. The food package of claim 10, wherein the food container is a bag.

18. The food package of claim 17, wherein the bag is cellulose.

19. The food package of claim 17, wherein the bag is paper.

20. The food package of claim 17, wherein the bag is plastics.

21. The food package of claim 10, wherein the food container is a box.

22. The food package of claim 21, wherein the box is paperboard.

23. The food package of claim 10, where the food container is a tray.

24. The food package of claim 23, wherein the tray is plastic.

25. The food package of claim 23, wherein the tray is paperboard.

* * * * *